US007490455B2

(12) United States Patent
Ferioli

(10) Patent No.: US 7,490,455 B2
(45) Date of Patent: Feb. 17, 2009

(54) COLLECTING, COMPACTING AND BAGGING DEVICE FOR WASTE IN GENERAL

(75) Inventor: Angel Delmo Ferioli, P. Alegre (BR)

(73) Assignee: Environmental Technologies International, LLC, Louisville, KY (US)

( * ) Notice: Subject to any disclaimer, the term of this patent is extended or adjusted under 35 U.S.C. 154(b) by 44 days.

(21) Appl. No.: 10/547,468

(22) PCT Filed: Mar. 10, 2004

(86) PCT No.: PCT/BR2004/000025

§ 371 (c)(1),
(2), (4) Date: Aug. 30, 2005

(87) PCT Pub. No.: WO2004/080847

PCT Pub. Date: Sep. 23, 2004

(65) Prior Publication Data

US 2006/0185329 A1 Aug. 24, 2006

(30) Foreign Application Priority Data

Mar. 11, 2003 (BR) ..... 0300535

(51) Int. Cl.
*B65B 63/02* (2006.01)

(52) U.S. Cl. ..... 53/529; 53/139.1; 100/220

(58) Field of Classification Search ..... 53/438, 53/439, 527, 529, 530, 139.1, 481, 136.5; 110/110, 215, 218, 219, 220
See application file for complete search history.

(56) References Cited

U.S. PATENT DOCUMENTS

| | | | | | |
|---|---|---|---|---|---|
| 2,698,500 | A | * | 1/1955 | Clegg | 53/529 |
| 2,780,987 | A | * | 2/1957 | Wall | 53/529 |
| 3,245,340 | A | * | 4/1966 | Logbeck | 100/233 |
| 3,253,537 | A | * | 5/1966 | Porter et al. | 53/529 |
| 3,580,166 | A | * | 5/1971 | Longo | 52/529 |
| 3,708,953 | A | * | 1/1973 | Aluotto | 53/527 |
| 3,757,682 | A | * | 9/1973 | Ritchie | 100/220 |
| 3,785,281 | A | * | 1/1974 | Ligh | 100/218 |
| 3,861,117 | A | * | 1/1975 | DeFilippi | 53/527 |
| 3,942,430 | A | * | 3/1976 | Day et al. | 53/527 |
| 3,968,619 | A | * | 7/1976 | Fishburne | 53/529 |
| 3,974,912 | A | * | 8/1976 | Buisson | 53/529 |

(Continued)

*Primary Examiner*—Louis K. Huynh
(74) *Attorney, Agent, or Firm*—Wood, Herron & Evans, LLP

(57) ABSTRACT

This invention refers to a self-transported or towed equipment whose purpose is to collect, compact, and bag domestic, industrial and farming waste. The equipment is made up of a chassis (1) supporting a closed body (2) that is opened at both ends and has a back cover (4) to close the body and a moveable front compression plate (5). A clasping device of the accordion-like tube encircles the back part of the body (1). A bag sealing mechanism (3), operated by hydraulic cylinders (35, 36) and pliers on (31) presses the loaded bag and squeezes it so as to place a sealing band manually. The lower part of the back cover (4) pivots on the chassis through a hydraulic cylinder (41) which is placed at the bottom of the chassis (1) and pulls cables (42) through grooved pulleys (43). The compression plate (5) is operated through a hydraulic system (6) made up of telescopic arms (61) propelled by independent hydraulics cylinders (62).

6 Claims, 14 Drawing Sheets

U.S. PATENT DOCUMENTS 4,004,398 A * 1/1977 Larsson et al. ..... 53/527
4,036,359 A * 7/1977 Strickland, Jr. ..... 53/529
5,459,982 A * 10/1995 Long ..... 53/529

* cited by examiner

COLLECTING, COMPACTING AND BAGGING DEVICE FOR WASTE IN GENERAL

BACKGROUND OF THE INVENTION

This invention refers to an apparatus that is self-transported or self-towed, aimed at collecting, compacting, and bagging residues in general such as domestic, industrial, and farming waste.

The open-air collection and disposal of rubbish and waste in general is a growing problem that has serious ecological consequences.

Automotive vehicles are provided to collect domestic refuse; these vehicles have been specially designed and fabricated with features to receive, and compact the loads collected. However, given their capacity and high cost, these are only viable in large urban centers. This is why many cities hire private companies to collect the garbage, as they are specialized in this activity.

On the other hand, simpler ways of collecting and transporting garbage, such as, for instance, open trucks, dump-carts, or simple carts do not attend hygiene and safety requirements for both the population and the operators of this system.

In the case of trucks designed for the specific purpose d collecting garbage, the compaction rate is low, and so the volume of material collected is high. Because of this, the trucks need to be constantly unloaded, which means that they have to return to the garbage dumps that are located at remote places, thereby increasing the fuel consumption.

In the case of vehicles that are not specifically aimed at collecting garbage, the material collected is not compacted, which reduces the transport capacity of the vehicles all the more, and obliges to do constant trips to unload them.

The manner in which the garbage is disposed is also just as serious an issue, since in most cities, it is left in open-air dumps. Insects, rodents and all kinds of microorganisms, pathogenic or not, proliferate in these infamous dumps. As a result, these dumps are highly detrimental to the environment, as they contaminate the adjacent spring and ground water due to the infiltration and to the leaching of the liquids resulting from the decomposition and of the rainwater respectively.

Generally speaking, the problems described above also occur with the treatment of industrial and farming waste.

SUMMARY OF THE INVENTION

This invention is therefore to have an equipment capable of solving the limitations of the abovementioned state of technology efficiently. The solution is a self-transported or self-towed piece of equipment, designed to collect, compact, and bag domestic, industrial, and farming waste. The equipment has a chassis, supporting a body that is closed with a back closing cover, it also has a movable front plate that compresses the waste, and is displaced through a hydraulic system. The back cover moves at a certain angle of the chassis and transforms into a chute to unload the material collected and compacted. A peripheral feeding device from a waterproof and flexible tube minimizes the harmful effects on nature. The tube has a closing device that enables the operator to apply a sealing band at the end of the bag while applying a second sealing band before sectioning the tube to form the bottom of a new bag.

The collecting, compacting and bagging equipment that is the subject of this invention presents the following advantages on the state of technology:

- it has a waste compacting system with a compression plate that is operated through a hydraulic cylinder and driven through a telescopic arm, which ensures a high compression rate and drastically reduces the volume of waste;
- it increases significantly the transport capacity of the vehicle, since the material collected presents a high compacting rate;
- it has a hydraulic mechanism for tilting the compression plate that ensures a homogenous compaction of the waste over the entire volume of the equipment body;
- it has a two-part compression plate with an upper tilting portion that enables to introduce waste through the front and leaving the entire volume of the body free for loads;
- it has a feeding device for a continuous end waterproof tube to bag the compacted waste, which is attached to the back cover,
- it has an automatic bag sealing device, which only requires that the operator passes and closes the sealing band when the tube is full and when the tube is ready to be filled up;
- it has a tilting back cover that serves as a discharge chute of the sealed bag filled with compacted waste;
- it has a collecting system for the liquids and drippings extracted from the waste during collection and compressing, thereby ensuring a safe and hygienic operation.

DESCRIPTION OF DRAWING

The waste collecting, compacting and bagging equipment in reference in this invention is easier to understand in the following specifications, which are given through the drawings in appendix and listed below; these illustrate the best concretization form, which must not be looked upon as limiting for the invention, where.

DETAILED DESCRIPTION OF THE INVENTION

Figure 1:
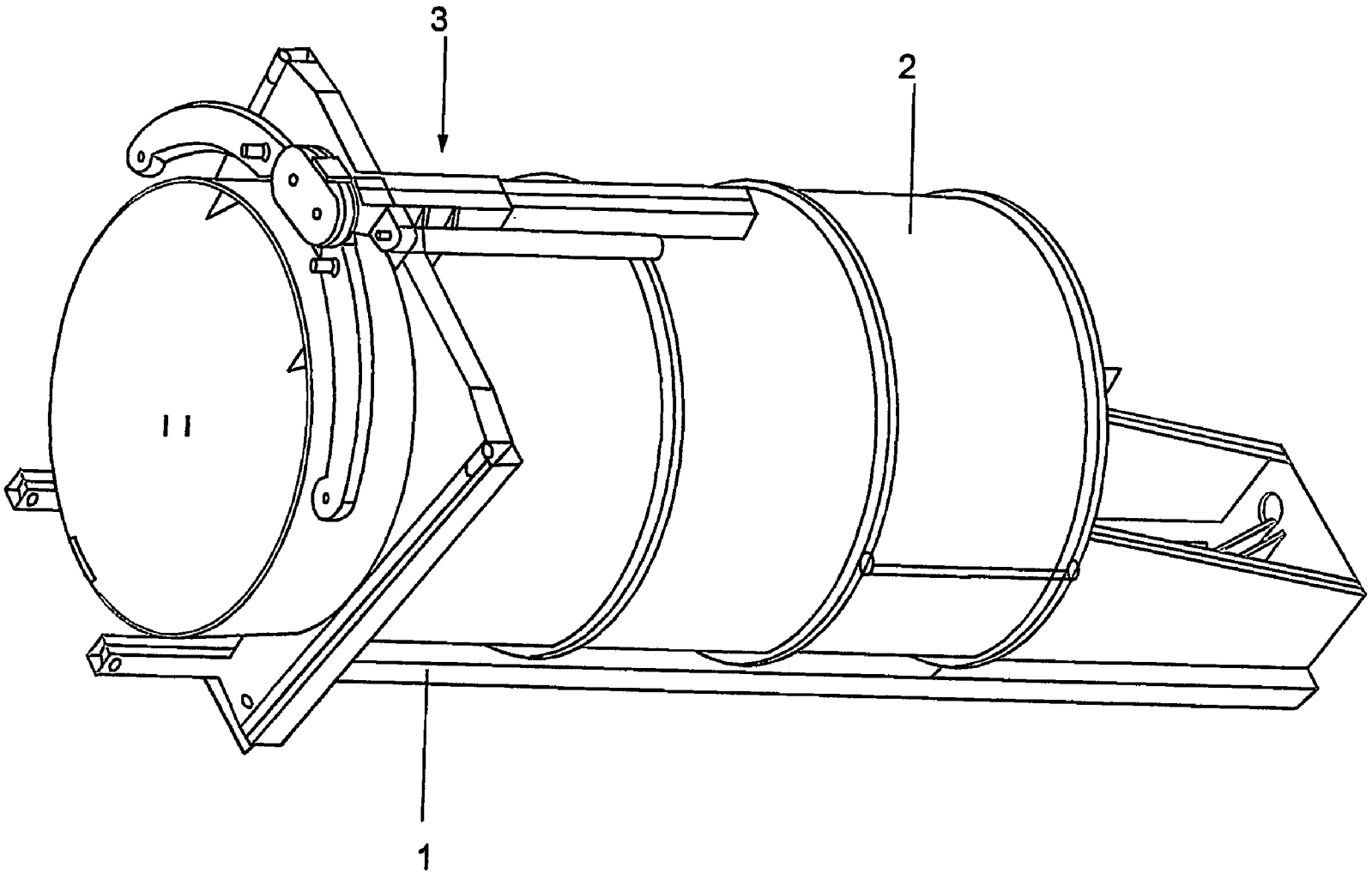
FIG. 1 equipment perspective.
Figure 2:
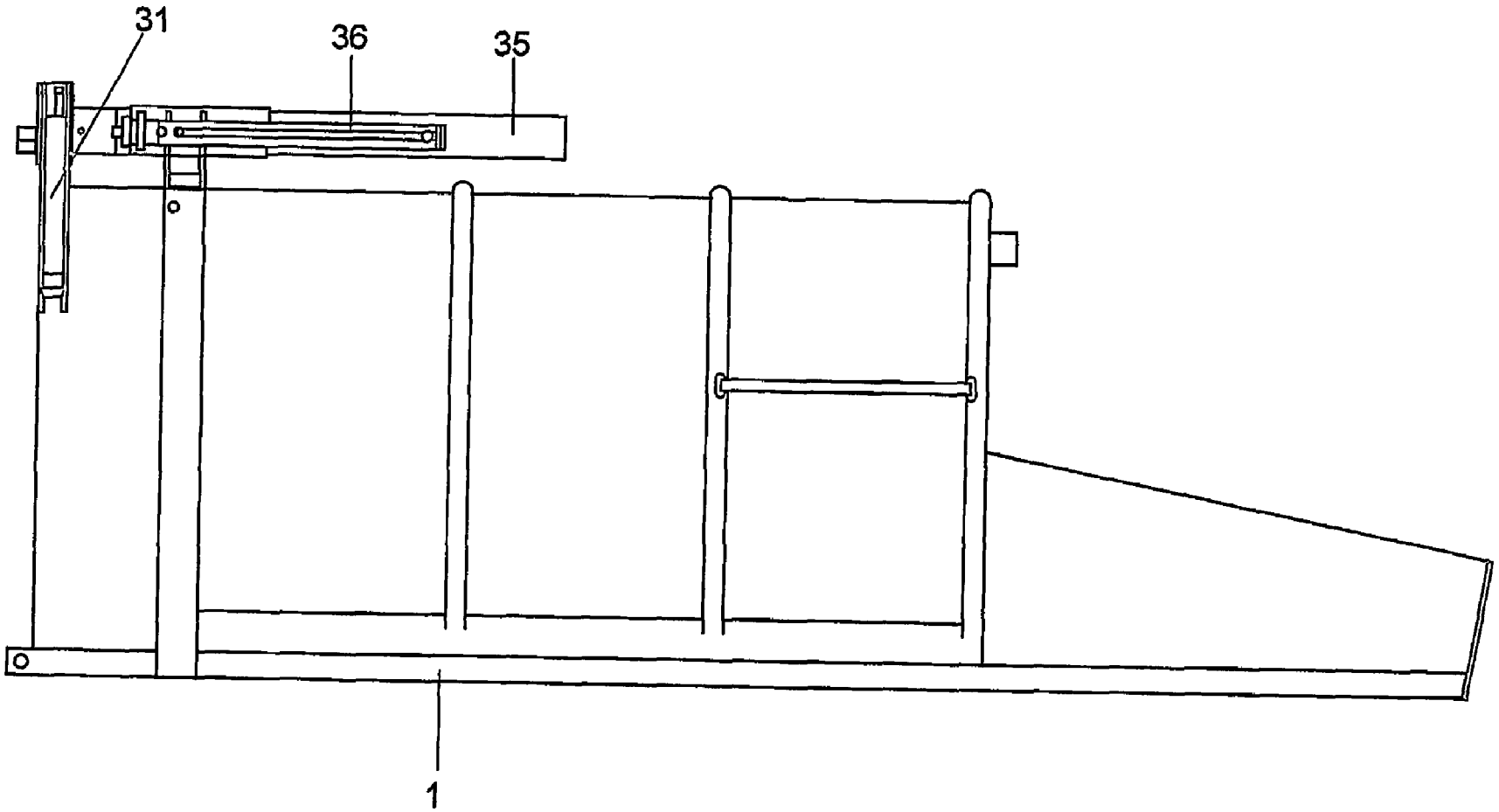
FIG. 2 side view of the equipment.
Figure 3:
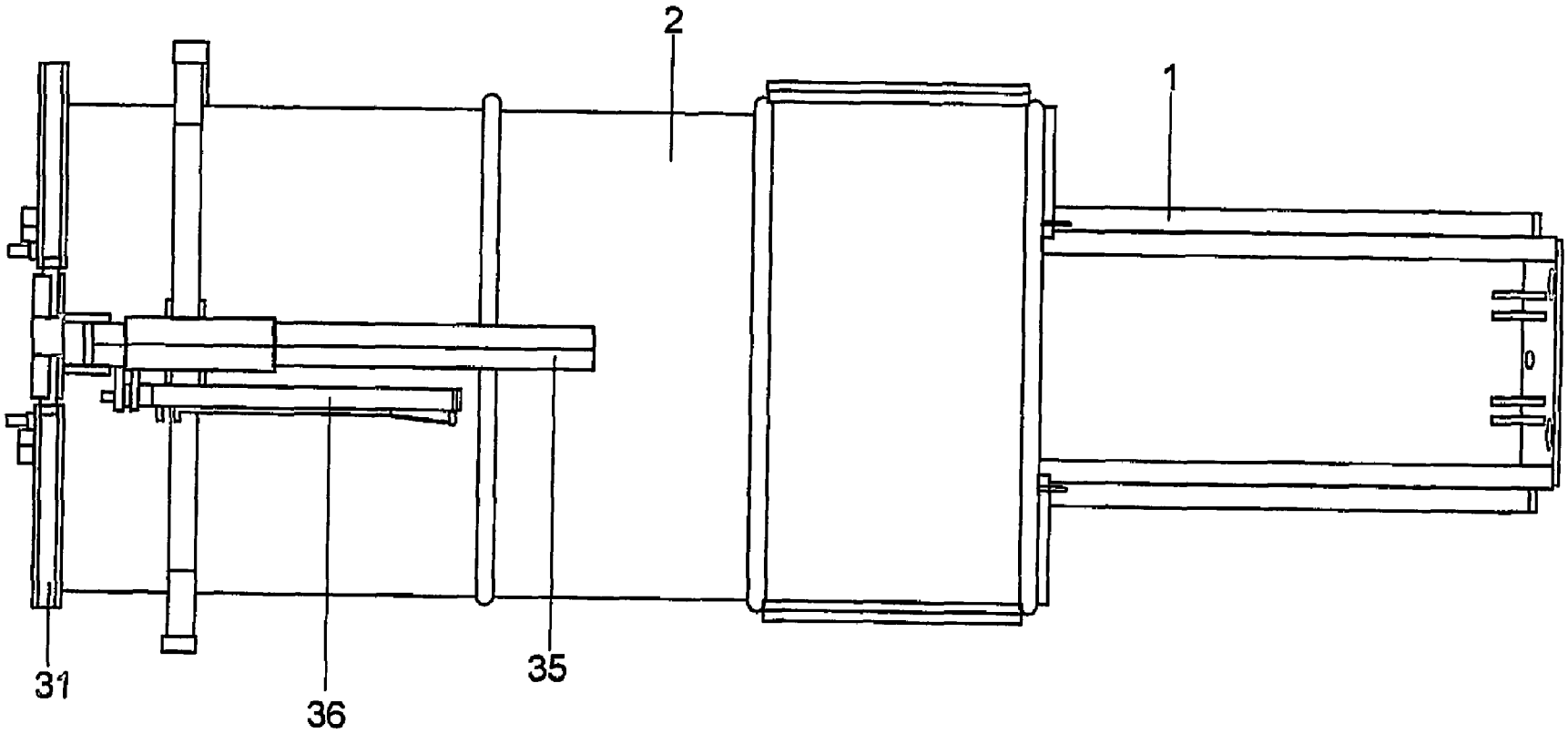
FIG. 3 upper view of the equipment.

FIGS. 1 to 3 show the equipment invented with the chassis (1), supporting a closed body (2), preferably a cylindrical chamber that is opened at both ends and has a back cover to close the body and a moveable front compression plate (not shown in these figures). A clasping device of the accordion-like tube encircles the back part of the body (1). A bag sealing mechanism (3), operated by hydraulic cylinders (35 and 36) and pliers (31) presses the loaded bag and squeezes it so as to place a sealing band manually.

Figure 4:
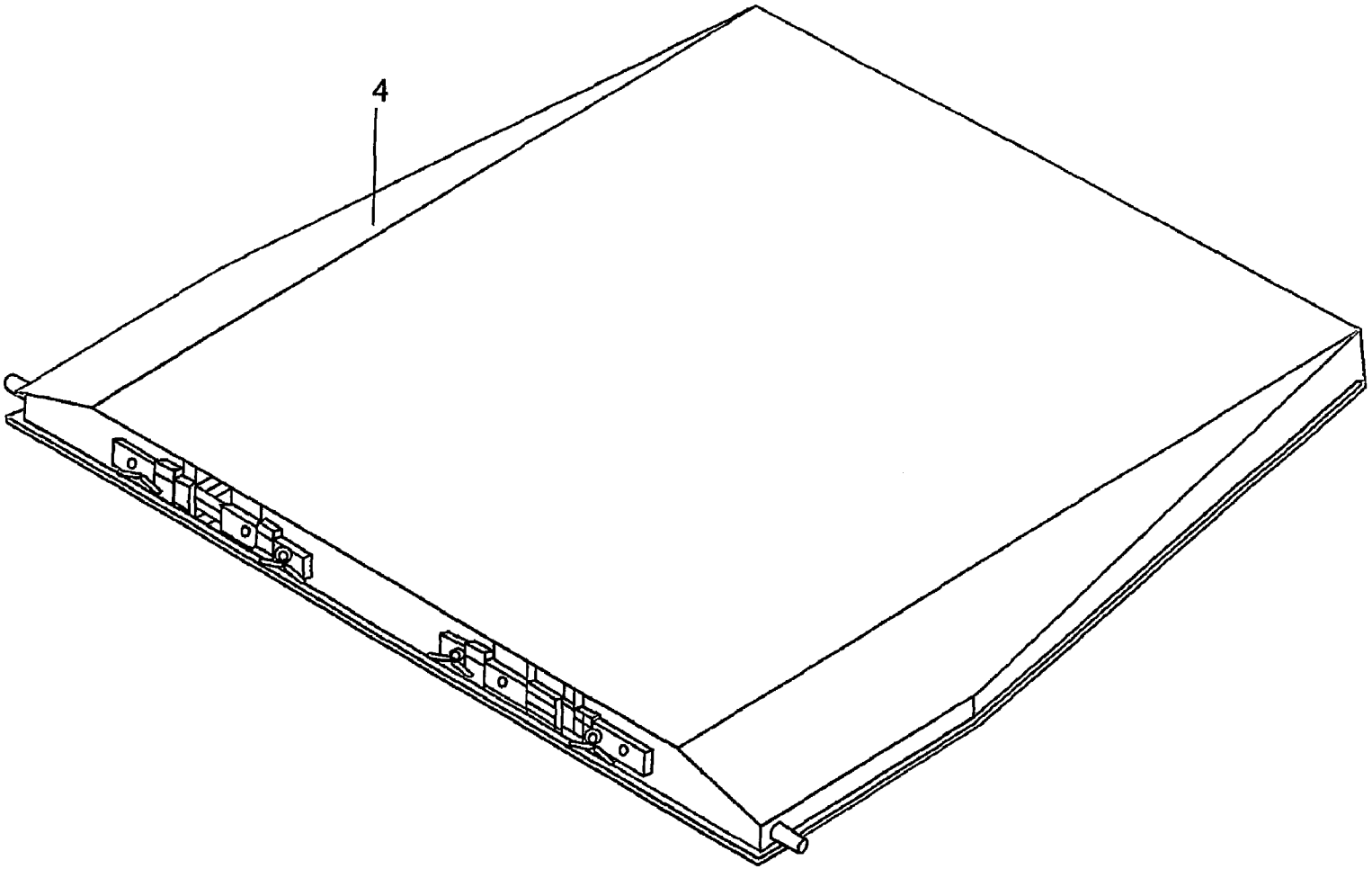
FIG. 4 view from the back cover of the equipment.
Figure 5:
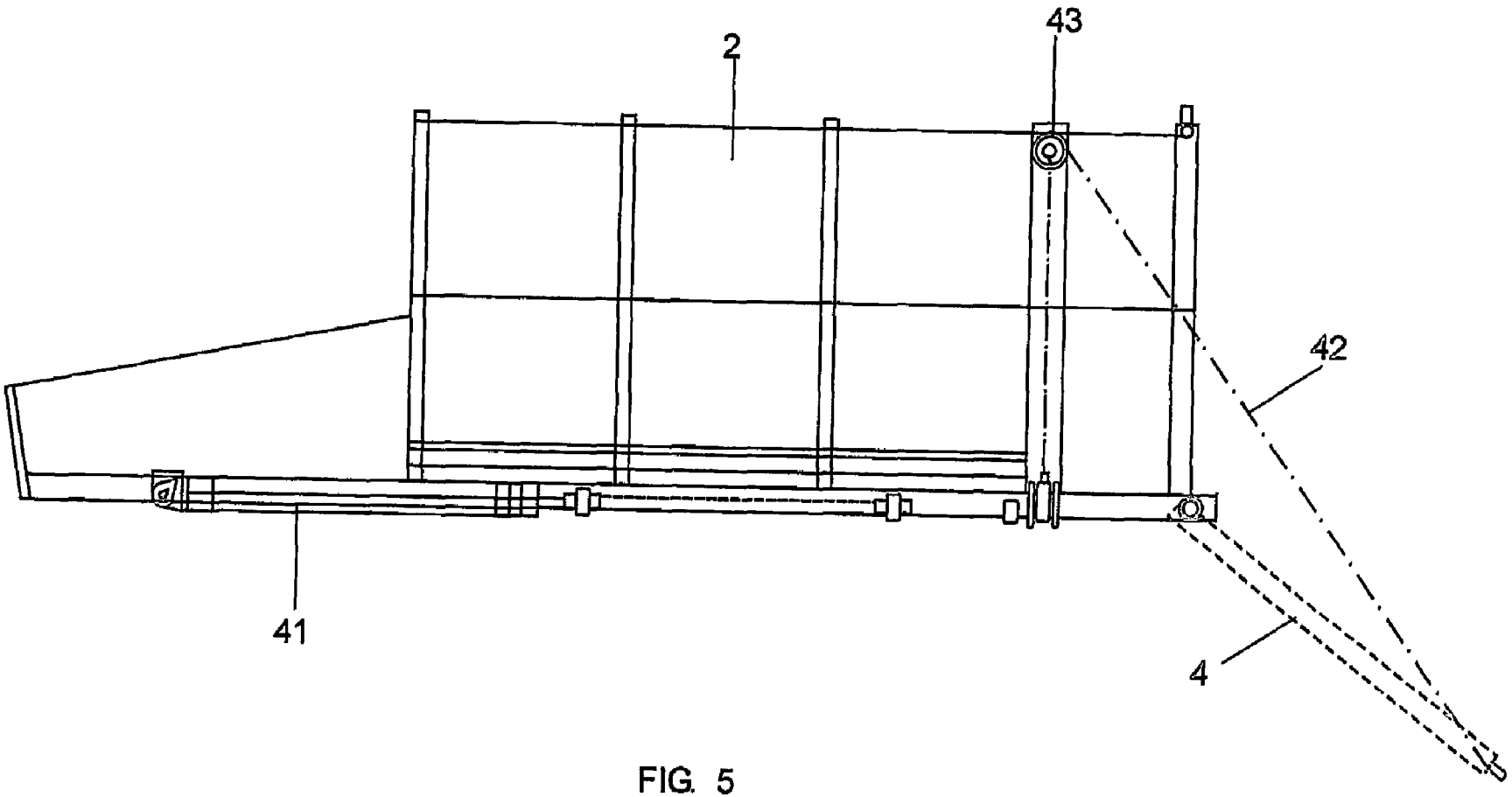
FIG. 5 side view of the equipment detailing the operating mechanism of the back cover.
Figure 6:
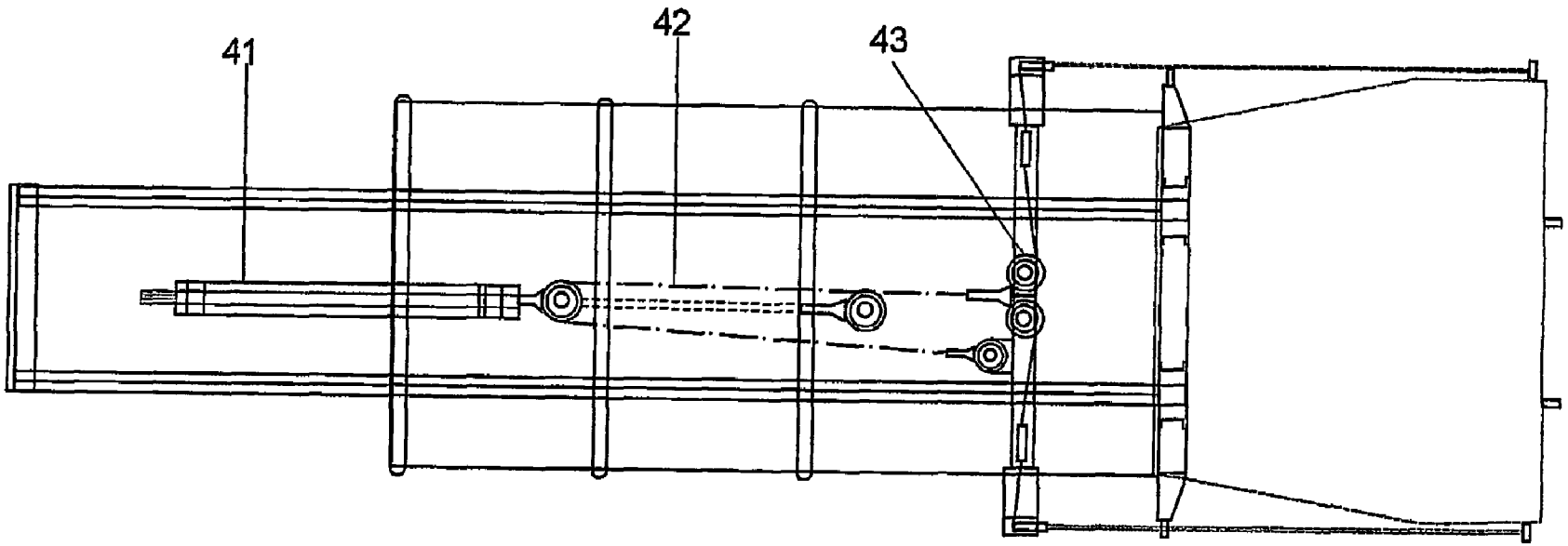
FIG. 6 lower view of the equipment detailing the operating mechanism of the back cover.

FIGS. 4 to 6 show the back cover (4) whose lower part pivots on the chassis (1) and transforms into a discharge chute for the collected, compacted, and bagged material. The opening and closing of the cover (4) is operated by a hydraulic cylinder (41) which is placed at the bottom of the chassis (1) and pulls cables (42) which lower or the aforesaid cover (4) thanks to grooved pulleys (43).

Figure 7:
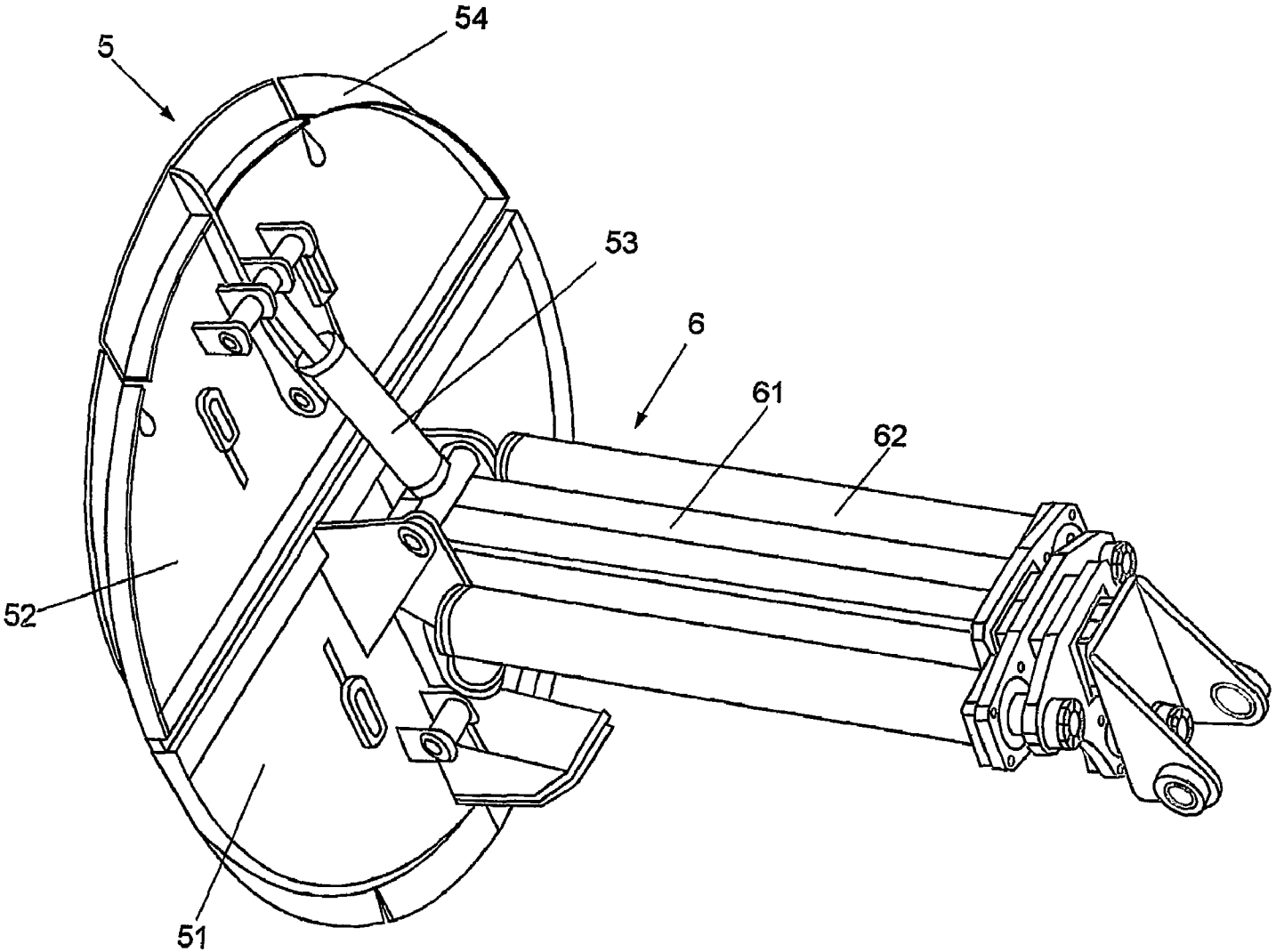
FIG. 7 perspective of the compression plate.
Figure 8:
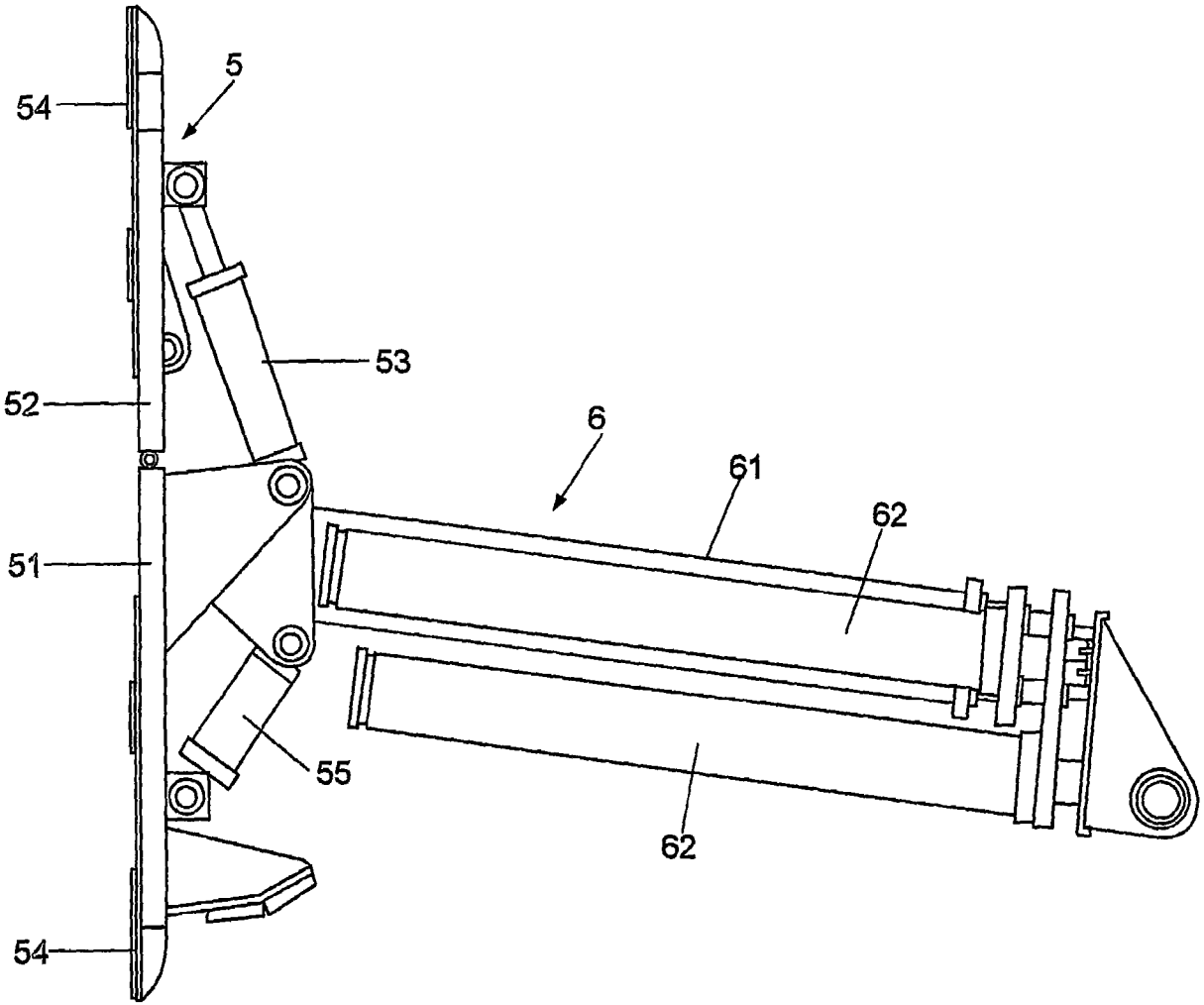
FIG. 8 side view of the compression plate.
Figure 9:
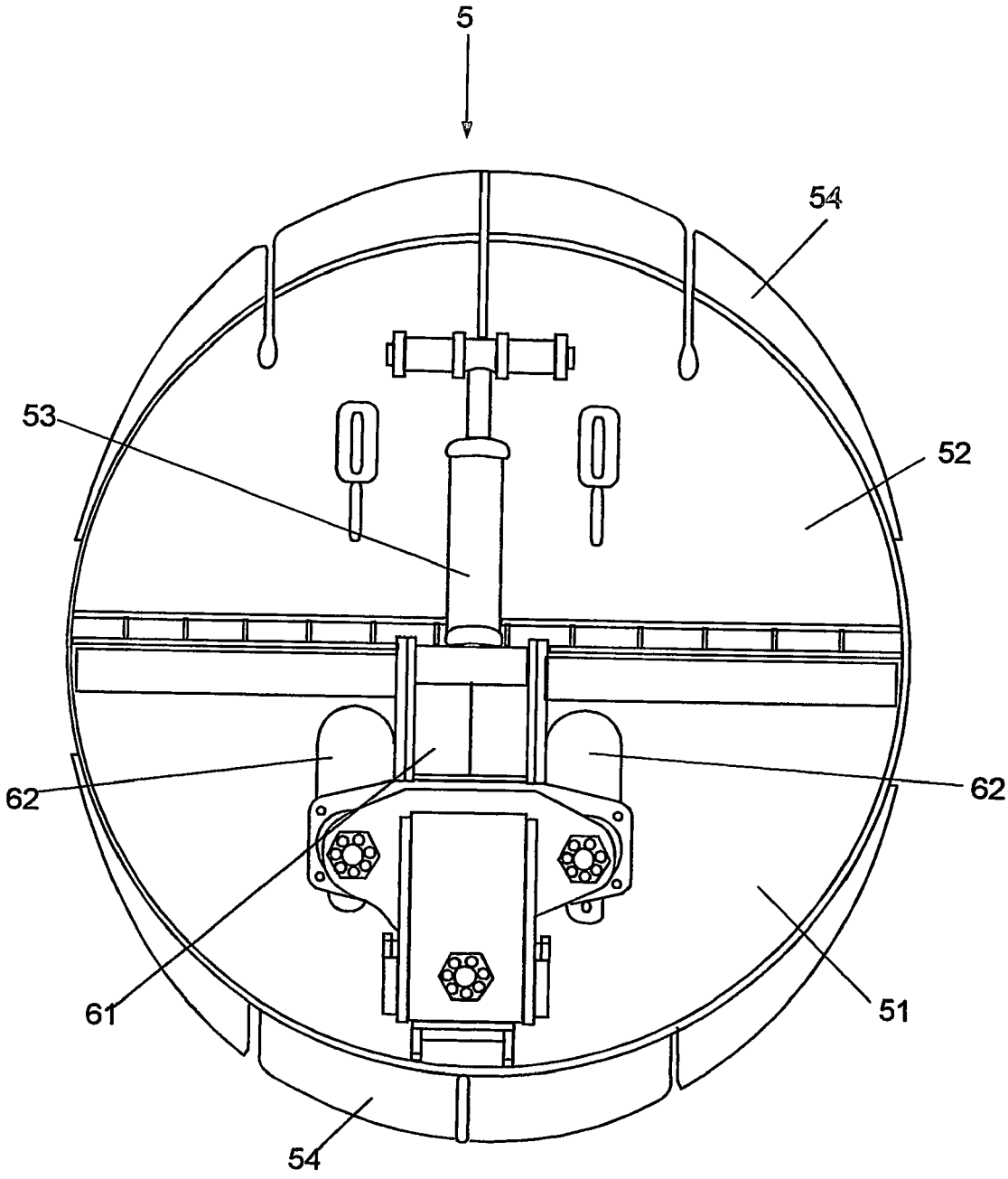
FIG. 9 front view of the compression plate.

FIGS. 7 to 9 detail the compression plate (5) that is operated through a hydraulic system (6), preferably made up of four telescopic arms (61) which are propelled by three independent hydraulic cylinders (62). So, you obtain the rigidity characteristic of telescopic arms that are operated by dint of independent hydraulic cylinders of identical diameter, which surpasses the advantages presented by the traditional telescopic hydraulic cylinders of decreasing diameters.

The compression plate (5) is made up of a lower semicircle (51) on which an upper semicircle (52) swings. The upper semi-plate (52) is moved by a hydraulic cylinder (53) and is maintained down constantly so as to form a front opening to load the body (2).

Due to the inclination of the compression plate (5) on its way inside the body (2) the compression plate has a pair of sliding tongues (54) which turn the plate (5) whenever they are set backwards and turn the plate (5) into an elliptical shape whenever they are put forwards.

Figure 10:
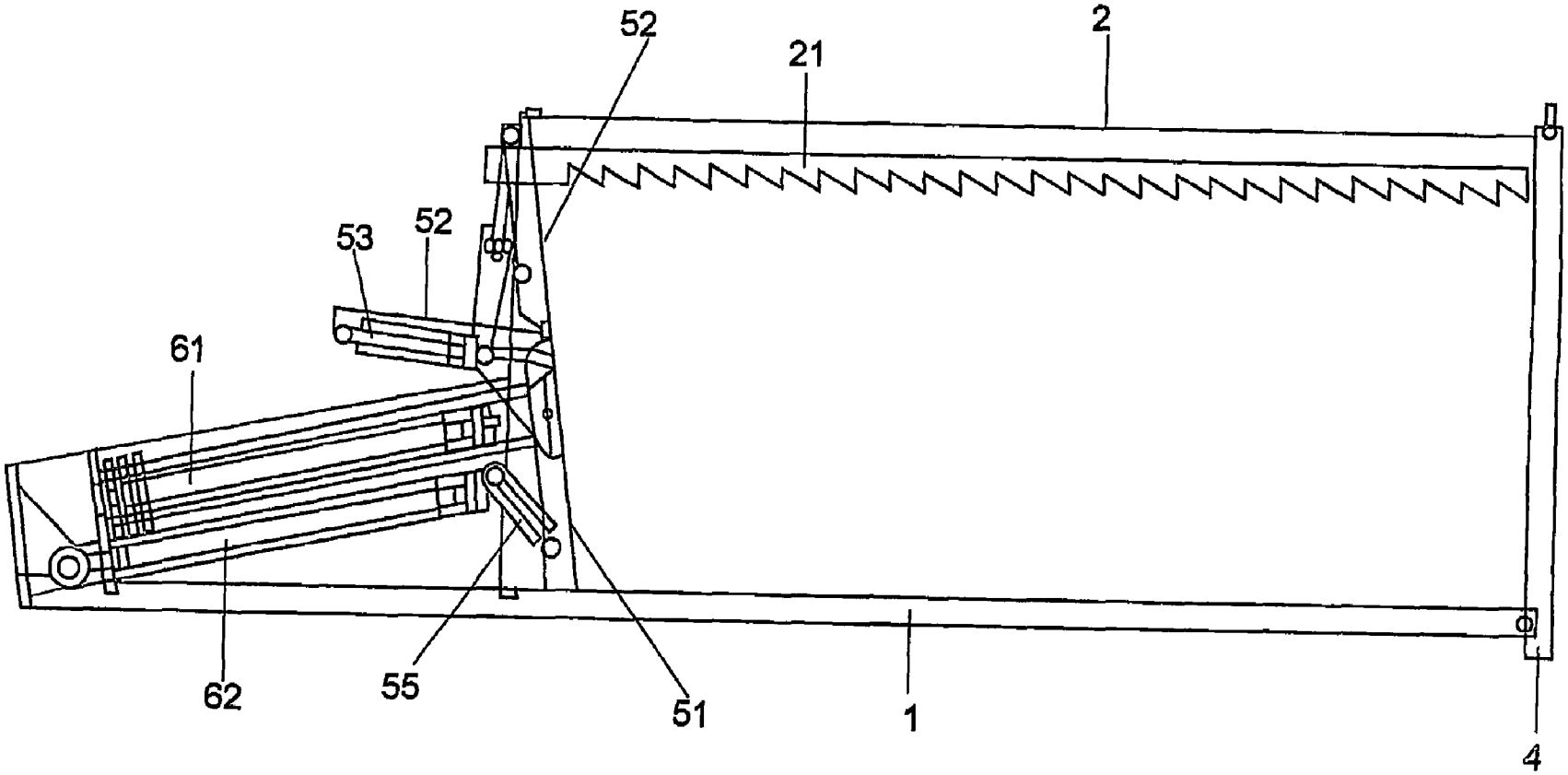
FIG. 10 side section of the equipment with the compression plate set backwards.
Figure 11:
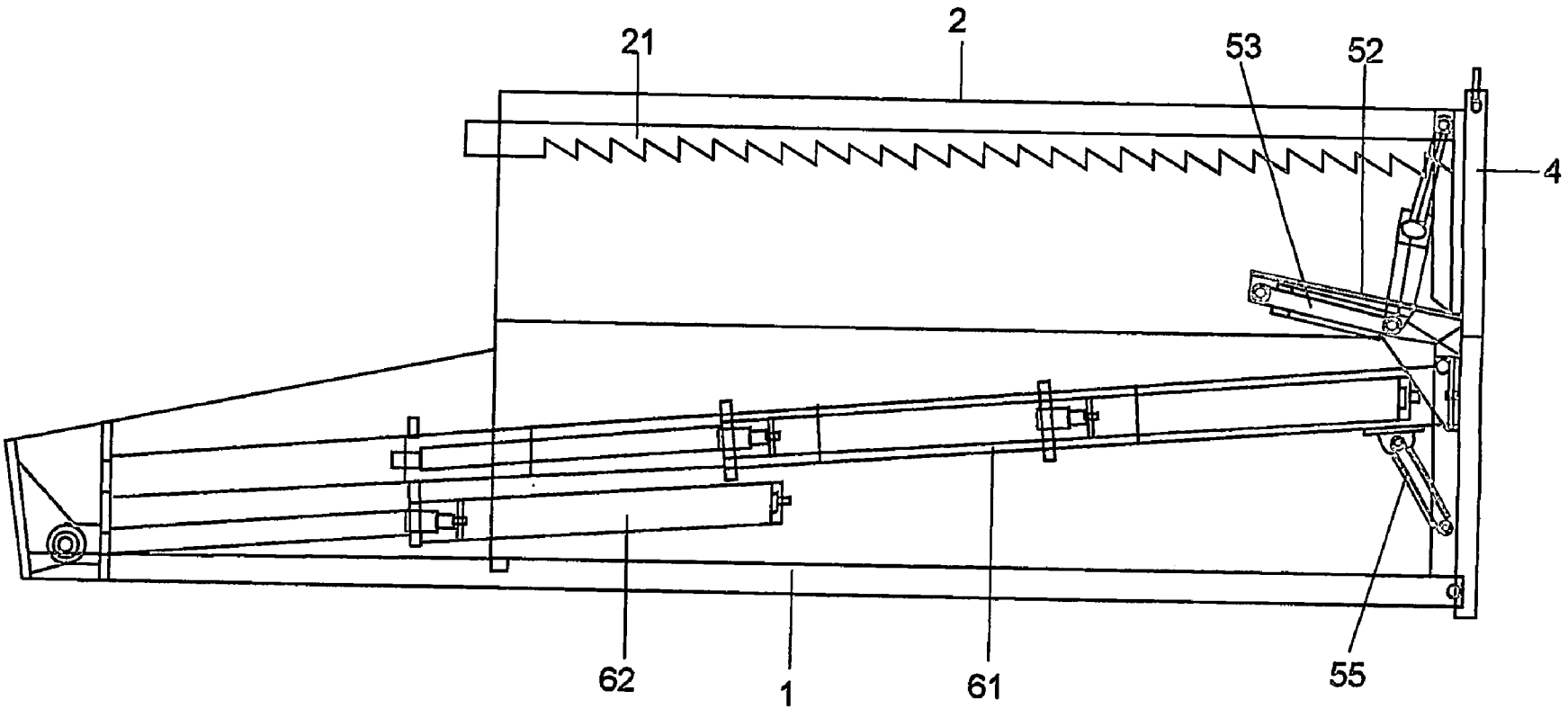
FIG. 11 side section of the equipment with the compression plate set forwards.

FIGS. 10 and 11 show the compacting cycle of the waste load when the plate (5) is moved backward towards the back cover (4) through the telescopic arms (61) propelled by the hydraulic cylinders (62). On initiating the compaction stage, this plate (5) is inclined so as to help raise the waste and stop a higher degree of compaction at the base of the body (2). At the end of the cycle, a hydraulic cylinder (55) corrects the position of the plate (5) by turning it orthogonally to the axis of the body and parallel to the cover (4.). To stop the compacted waste from returning with the plate (5), sprocket plates (21) are placed in the upper part, inside the body (2).

Figure 12:
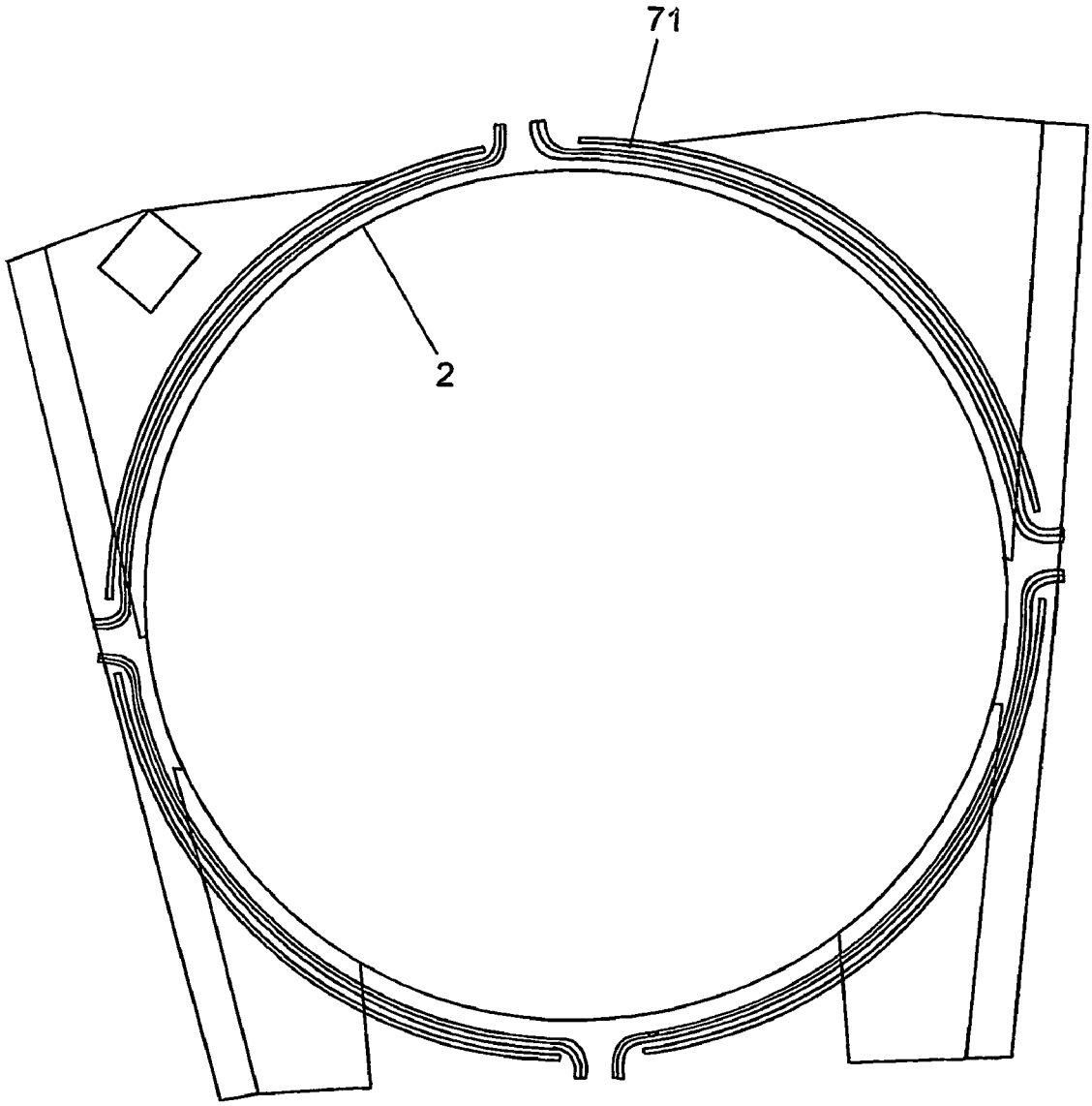
FIG. 12 front view of the set of clips of the bagging tube.
Figure 13:
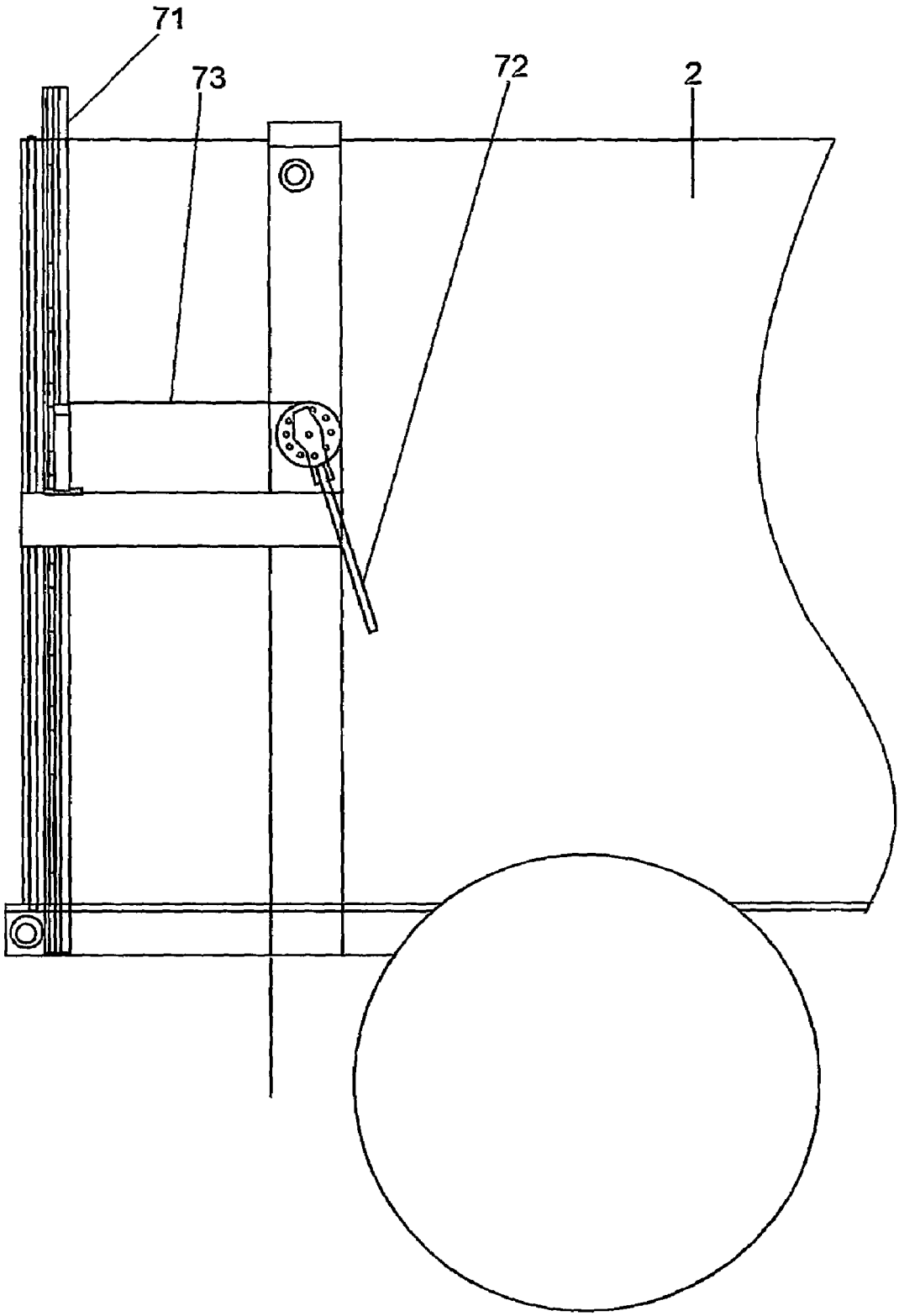
FIG. 13 side view of the set of clips of the bagging tube.

FIGS. 12 and 13 detail a clasping apparatus comprising a set of clips (7) at the back of the body (2). This tube can be folded so as to enable a long-sized load in a reduced place. The device has four arc-shaped clips (71) that press the tube blade against the external surface at the back of the body (2). A lock (72) loosens the cables (73) that maintain the clip (71) pressed against the body (2). The lock (72) is operated whenever a quick liberation of a portion of the tube is required during the unloading of the compacted waste.

Figure 14:
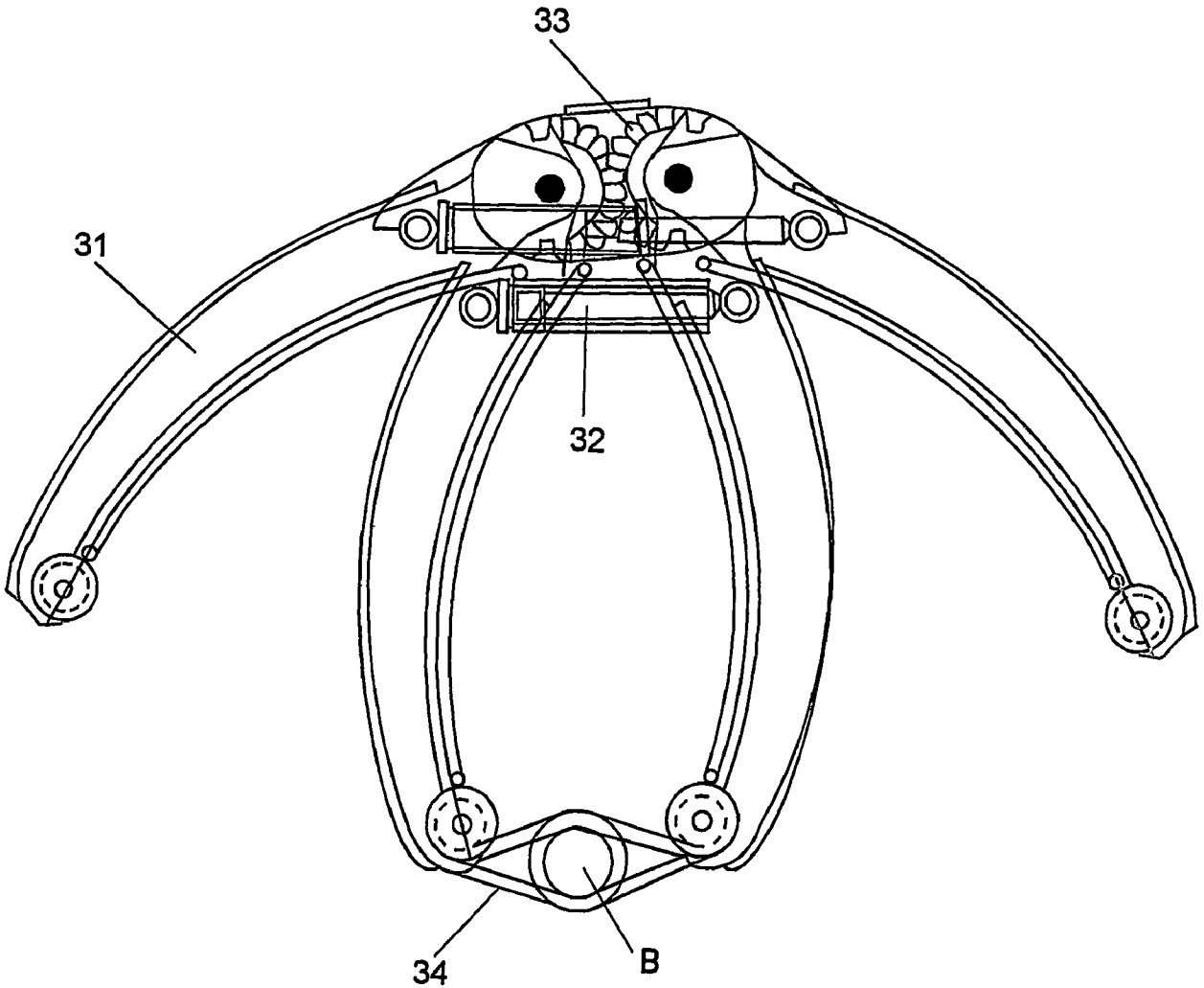
FIG. 14 front view of the set of closing pliers of the tube.

FIG. 14 shows the bag sealing mechanism (3) separately; the mechanism is made up of two arc shaped pliers (31) that are operated by a hydraulic cylinder (32) and synchronized by toothed segments (33). The pliers (31) serve to guide and lead the two flexible and retractile coiled ropes (34) like forks that encircle the end portion of the bag (B) and make it touch the back of the body (2). Those ropes (34) are drawn back thanks to a grooved-pulley system pulled through a hydraulic cylinder (35), which closes the bag by squeezing it. The pliers (31) moving transversally in a scissor type of way serve to always guide the rope (34) loop towards the central portion of the bag mouth.

Before starting to compress the tube with the rope (34), the entire structure of the pliers (31) is propelled outside the body (2) through the hydraulic cylinder (36), thereby leaving the pliers (31) free to squeeze the already filled tube. This is when part of the tube also slides and follows the movement.

Besides closing the bag, the pliers (31) move longitudinally through a hydraulic arm (36) that pushes the bag towards the back cover (4) that is already lowered, thereby allowing for the opening of enough space to place the sealing band that closes the bag.

Using the pull of gravity, a dripping tank (not shown) placed at the lower back part of the body (2) has a lower drainpipe (not shown) that collects the liquids obtained through compaction.

The operating sequence of the equipment is made up of the following steps:

- it starts by collecting the waste that is thrown manually inside the body (2) thanks the opening at the front when the upper semi-plate (52) of the compression plate (5) is turned downwards;
- the compression plate (5) compacts the load at regular intervals after the upper semi-plate (52) is lifted and the hydraulic cylinders (62) and the respective arms (61) towards the closing cover of the body (4) are operated.
- after various successive cycles of compressing and loading the waste collected, the load must first be unloaded by opening the back cover (4) that forms a chute for the bagged waste;
- by that time, the tube opening is already closed by the sealing band and the bottom is in contact with the internal surface of the cover (4) before the opening when the cylinders (62) start throwing the compacted waste out, which pulls the adequate length of tube;
- once this ejection is over, the bag sealing device (3) is operated; it first ejects the pliers structure (31) outside the body (2) through the hydraulic cylinder (36) and after the rope (34) is pulled by the hydraulic cylinder (35) thereby squeezing the tube that is full;
- the bagged load is propelled outside on the chute formed by the back cover (4); the operator applies the sealing band to close the tube and a second one at same distance so as to close the opening of a new portion of tube, before finally cutting it, thereby separating the bag;
- a new step is then initiated to load the waste; the set of pliers (31) is drawn back and the back cover (4) is lifted; the plate (5) is drawn back and the upper semi-plate (52) is lowered to open the front opening and load the waste.

Off course, the equipment suggested in this invention might be used for other means like, for instance, to bag raw material of diverse types. It also may be used efficiently to form silos and to put vegetal material into silos.

What is claimed is:

1. Collecting, compacting and bagging apparatus for waste material and comprising:

- a chassis supporting a chamber having open ends;
- a back cover oriented proximate a discharge end of the chamber for selectively closing said discharge end;
- a front compression plate operably attached for movement by a system of hydraulic cylinders;
- an accordion-like extendible tube surrounding a portion of the chamber proximate said discharge end;
- a clasping apparatus operably disposed for holding said tube proximate said discharge end of the chamber;
- a bag sealing apparatus operable to squeeze a portion of said tube when filled with waste to facilitate application of a sealing band thereto; and
- wherein said front compression plate comprises a lower semicircle member on which an upper semicircle member swings, the upper semicircle member being movable by a hydraulic cylinder so as to form a front opening to load the chamber.

2. Collecting, compacting and bagging apparatus for waste material and comprising:

- a chassis supporting a chamber having open ends and a closing, swinging cover at back end of the chamber;
- a back cover oriented proximate a discharge end of the chamber for selectively closing said discharge end;

a front compression plate operably attached for movement by a system of hydraulic cylinders;

said front compression plate comprising a lower semicircular member on which an upper semicircular member swings, the upper semicircular member being moveable by a hydraulic cylinder so as to form a front chamber opening to load the chamber;

an accordion-like extendible tube surrounding a portion of the chamber proximate said discharge end;

a clasping apparatus operably disposed for holding said tube proximate said discharge end of the chamber;

a bag sealing apparatus operable to squeeze a portion of said tube when filled with waste to facilitate application of a sealing band thereto; and said lower semicircular member of said front compression plate having an inclination for lifting waste material and preventing a higher degree of compaction at the bottom of the chamber, said inclination maintained by a hydraulic cylinder operably connected to said front compression plate.

3. Collecting, compacting and bagging apparatus for waste material and comprising:

a chassis supporting a chamber having open ends;

a back cover oriented proximate a discharge end of the chamber for selectively closing said discharge end;

a front compression plate operably attached for movement and inclination by a system of hydraulic cylinders;

an accordion-like extendible tube surrounding a portion of the chamber proximate said discharge end;

a clasping apparatus operably disposed for holding said tube proximate discharge end of the chamber;

a bag sealing apparatus operable to squeeze a portion of said tube when filled with waste to facilitate application of a sealing band thereto; and wherein said front compression plate includes a pair of sliding tongues for shaping said plate into an elliptical shape upon inclination of said plate within said chamber.

4. Collecting, compacting and bagging apparatus for waste material and comprising:

a chassis supporting a chamber having open ends;

a back cover oriented proximate a discharge end of the chamber for selectively closing said discharge end;

a front compression plate operably attached for movement by a system of hydraulic cylinders;

an accordion-like extendible tube surrounding a portion of the chamber proximate said discharge end;

a clasping apparatus operably disposed for holding said tube proximate said discharge end of the chamber;

a bag sealing apparatus operable to squeeze a portion of said tube when filled with waste to facilitate application of a sealing band thereto; and further including sprocket plates placed in an upper part of said chamber for stopping the waste from withdrawing along with said front compression plate.

5. Collecting, compacting and bagging apparatus for waste material and comprising:

a chassis supporting a chamber having open ends;

a back cover oriented proximate a discharge end of the chamber for selectively closing said discharge end;

a front compression plate operably attached for movement by a system of hydraulic cylinders;

an accordion-like extendible tube surrounding a portion of the body proximate said discharge end;

a clasping apparatus operably disposed for holding said tube proximate said discharge end of the chamber; and a bag sealing apparatus operable to squeeze a portion of said tube when filled with waste to facilitate application of a sealing band thereto, and including a bag sealing mechanism having two arc-shaped pliers operated through hydraulic cylinders and synchronized by toothed segments, the pliers serving to guide and lead two flexible and retractile coiled ropes encircling the end of the bag before being drawn back through a grooved pulley system pulled through a hydraulic cylinder, and which close the bag by squeezing it.

6. Collecting, compacting and bagging apparatus for waste material and comprising:

a chassis supporting a chamber having open ends including a discharge end;

a back cover oriented proximate a discharge end of the chamber for selectively closing said discharge end and for lowering to open said discharge end;

a front compression plate operably attached for movement by a system of hydraulic cylinders;

an accordion-like extendible tube surrounding a portion of the chamber proximate said discharge end;

a clasping apparatus operably disposed for holding said tube proximate said discharge end of the chamber;

a bag sealing apparatus operable to squeeze a portion of said tube when filled with waste to facilitate application of a sealing band thereto; and pliers mounted on a moveable member disposed at the discharge end of the chamber for extension of said pliers longitudinally to pull the tube onto said back cover when lowered, thereby pulling said tube away from said chamber for closure over compacted waste.

* * * * *